US006074072A

United States Patent [19]

Parsons et al.

[11] Patent Number: 6,074,072

[45] Date of Patent: Jun. 13, 2000

[54] LAMP ASSEMBLY FOR A FLASHLIGHT

[75] Inventors: Kevin L. Parsons, Appleton, Wis.; Don Keller, Irving; Clay Reeves, Dallas, both of Tex.; Dan Greaney, Nogales, Ariz.

[73] Assignee: Armament and Procedures, Inc., Appleton, Wis.

[21] Appl. No.: 09/126,514

[22] Filed: Jul. 30, 1998

[51] Int. Cl.[7] ..... F21L 7/00

[52] U.S. Cl. ..... 362/202; 362/203; 362/208

[58] Field of Search ..... 362/157, 186, 362/187, 188, 202, 203, 208

[56] References Cited

U.S. PATENT DOCUMENTS 4,286,311 8/1981 Maglica ..... 362/187

5,124,894 6/1992 Shiau ..... 362/187

5,651,607 7/1997 Hou ..... 362/187

OTHER PUBLICATIONS

U.S. Patent Application Ser. No. 08/738,858, Figure 2D.

*Primary Examiner*—Darren E. Schuber

*Attorney, Agent, or Firm*—McDonnell Boehnen Hulbert & Berghoff

[57] ABSTRACT

A lamp assembly for a flashlight including an assembly member, a base carrying a bulb, a board containment member for containing the base within the assembly member, and a fastener for retaining the board containment member against the base. The fastener has external threading which mates with internal threading provided in the through bore of the assembly member.

43 Claims, 1 Drawing Sheet

LAMP ASSEMBLY FOR A FLASHLIGHT

FIELD OF THE INVENTION

The invention is generally related to flashlights and is more specifically directed to a lamp assembly for use in flashlights.

BACKGROUND OF THE INVENTION

Flashlights are well-known in the prior art and have been heavily utilized in emergency situations and by law enforcement personnel in the execution of their duties. During use, such flashlights may be subjected to harsh environments and treatment. Flashlights should therefore be designed to withstand the application of various forces, such as the force from retracting an expandable baton when attached to such a weapon, impact with the ground if dropped to unholster a weapon, or forces from the recoil of a firearm when attached as a lighting device. In addition, flashlights should withstand the presence of debris, including water and mud, that could interfere with the operation of the flashlight.

Generally, such flashlights include a housing that is formed of a body section and a head section. The head section typically houses a lens, a reflector, and a lamp assembly, all of which are secured in the head section by a lens ring that is threadingly engaged with the head section. The body section houses batteries utilized to energize the lamp and a switch assembly to control the operation of the lamp.

One example of a lamp assembly 10 is shown in FIG. 1 of the present application and discussed in detail in commonly owned U.S. patent application Ser. No. 08/738,858, which is still pending and which is hereby incorporated by reference. The lamp assembly 10 of the flashlight permits for the adjustment of the light beam but prevents the inadvertent displacement of the lamp relative to the reflector.

As shown in FIG. 1, the lamp assembly 10 includes an outer adjustment ring 12, a lamp bulb 14, a bulb shock absorber 16, a circuit board 18, a board containment plate 20, and non-conductive fasteners 22. The outer adjustment ring 12 has a through bore 25 in which is defined a first internal radial shoulder 27 and a second internal radial shoulder 29. Threaded fastener bores 31 are provided on the second radial shoulder 29, extending coaxially with the through bore 25.

The lamp bulb 14 and the bulb shock absorber 16 are mounted on the circuit board 18. In use, all three elements are seated in the through bore 25 of the outer adjustment ring 12, with the circuit board 18 abutting against the second radial shoulder 29. The circuit board 18 is provided with fastener bores 33 that are intended to axially align with the fastener bores 31 of the outer adjustment ring 12.

The board containment plate 20 is disposed adjacent to the circuit board 18 to contain the board 18 within the adjustment ring 12. The plate 20 is provided with an annular shoulder 35 and countersunk bores 36. When disposed to contain board 18, the annular shoulder 35 abuts the first radial shoulder 27 of the ring 12. The bores 36 are intended to align axially with the threaded fastener bores 31 of the adjustment ring 12 and the fastener bores 33 of the board 18. This permits the non-conductive threaded fasteners 22 to extend through the plate 20 and the board 18, and to threadingly engage the threaded fastener bores 31 of ring 12 so that the board 18 is secured within the adjustment ring 12.

Once the board containment plate 20 is disposed adjacent to the circuit board 18 and the fasteners 22 are threaded in place, the o-rings 40 can be mounted on the outer adjustment ring 12, just above the threading 42. The outer adjustment ring 12 is then threadingly engaged to the reflector, which is in turn mounted within the head section of the flashlight.

The lamp assembly 10 of FIG. 1 does have its drawbacks. One such drawback is the difficulty involved in assembly and disassembly. For example, if the circuit board is damaged and requires replacement, the lamp assembly must be taken apart. In order to do so, both the lens ring and the reflector must be removed from the head section of the flashlight. The lamp assembly 10 can then unscrewed from the reflector. Using a tool, both of the threaded fasteners 22 must be unscrewed and removed from the assembly. The removal of the fasteners allows the board containment plate 20 and the circuit board 18, which carries the lamp bulb 14, to be removed from the bore 25 of the outer adjustment ring 12. The lamp bulb 14 can then be detached from the circuit board 18 and the circuit board can be replaced. Once the new circuit board is in place, the above steps are reversed and the assembly 10 is re-assembled.

Such a process may take much time. The size of the threaded fasteners, in particular, makes disassembly awkward. The use of a small screwdriver can be very difficult. Even the use of a tool does not greatly facilitate the removal of the fasteners. Also, it is possible that the fasteners may be lost due to their small size. The loss of these fasteners would hinder the re-assembly of the flashlight.

In addition to being difficult to work with, the fasteners do not have adequate strength. The fasteners are made of a non-conductive material such as nylon. During use of the flashlight, the fasteners sometimes sheer off. To address this problem, the fasteners are fabricated of metal, instead of nylon. The fasteners being constructed of metal, however, necessitate the use of non-conductive insulators. Unfortunately, this change increases the cost of the assembly without solving the strength problem. Even with the metal fasteners, the lamp assembly remains rather weak. Further, the presence of the non-conductive insulators introduces the potential for the screws to short circuit.

Another disadvantage of the lamp assembly 10 is brought about during its manufacture. Certain design features of the assembly 10 add considerably to the time required to manufacture it as well as the difficulty experienced in doing so. For example, the outer adjustment ring 12 requires two distinct internal radial shoulders 27 and 29 to be provided in its through bore 25. Machining such shoulders in the through bore 25 with the requisite dimensional accuracy is both difficult and tedious.

Further, the numerous bores required in the design of this assembly also add to the difficulty experienced during the manufacturing process. Threaded fastener bores 31 must be provided on the second radial shoulder 29 of the outer adjustment ring 12. Also, fastener bores 29 are required on the circuit board 18. In addition, countersunk bores 33 must be provided through the board containment plate 20. The small size of the elements and the dimensional accuracy required of the bores contributes to the difficulty experienced during the manufacturing process. The difficulty experienced during the manufacturing process and the time required to manufacture such an assembly both contribute to the cost of the lamp assembly.

Thus, there is a need in the prior art to provide a lamp assembly that can be quickly and easily disassembled to facilitate the replacement of the elements of the lamp assembly.

There is a further need for a lamp assembly that has the requisite amount of strength to withstand the rigors of use.

There is yet a further need for a lamp assembly that can be easily and accurately manufactured while keeping the manufacturing costs at a minimum.

SUMMARY OF THE INVENTION

The present invention overcomes the drawbacks of the lamp assemblies used in prior flashlights by providing an improved lamp assembly for retaining the lamp, the circuit board, and the outer adjustment ring in engagement with the reflector. The improved lamp assembly facilitates the replacement of the elements of the lamp assembly as well as reduces the difficulty experienced during the manufacturing process and the costs involved.

The lamp assembly of the present invention is provided with a single externally threaded fastener that mates with internal threading located along the through bore of the outer adjustment ring for retaining the lamp, the circuit board and the board containment member in place within the outer adjustment ring. The single externally threaded fastener obviates the need for the threaded fasteners of the prior art design. Thus, the lamp assembly is easier to disassemble because there is no need to fumble with two small fasteners that are oftentimes difficult to unscrew. Instead the lamp assembly can be easily and quickly disassembled by using a tool, such as a spanner wrench or a scissors found on a Swiss army knife, to unscrew the single fastener from the outer adjustment ring and remove the lamp and the circuit board therefrom. Thus, the elements of the lamp assembly can be replaced within a shorter amount of time.

The lamp assembly of the present invention also addresses the strength concerns of the prior lamp assemblies. The design of the externally threaded fastener provides the requisite amount of strength to withstand the external forces and stresses experienced by the lamp assembly during use.

Further, the present invention does not require the presence of two internal radial shoulders within the outer adjustment ring or the presence of fastener bores through the outer adjustment ring, the circuit board, and the board containment member. Due to its simplified design, the improved lamp assembly only requires the presence of a single internal radial shoulder within the outer adjustment ring. Thus, less time and difficulty is involved in manufacturing the outer adjustment ring. Further, the lamp assembly does not require the tapping of bores through the outer adjustment ring, the circuit board, and the board containment member of the assembly in order to accommodate threaded fasteners. Since the tapping of bores, particularly bores of such small dimensions, is both tedious and time-consuming, the manufacturing process of the lamp assembly is greatly facilitated. Because of its design, the lamp assembly of the present invention is both easier and less expensive to manufacture.

DETAILED DESCRIPTION OF THE INVENTION

Figure 3:
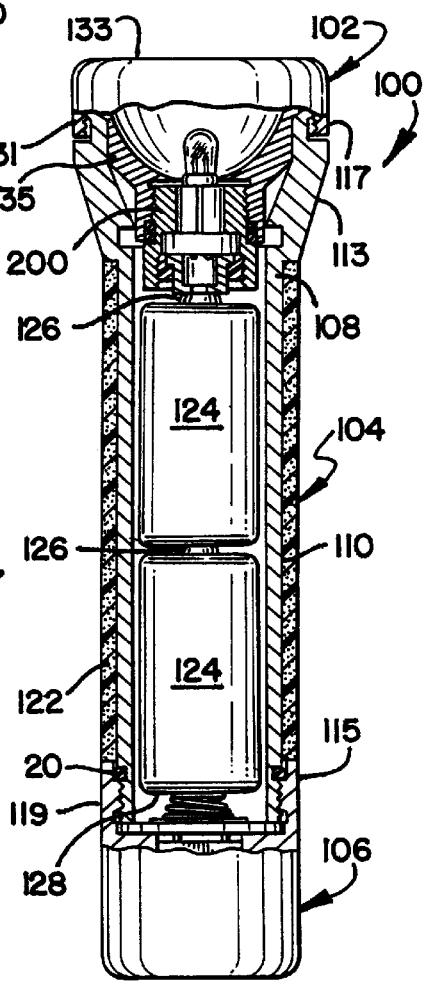
FIG. 3 is a cut-away side view of a flashlight with the lamp bulb assembly of the present invention.

Referring to FIG. 3, a flashlight 100 with the lamp bulb assembly 200 of the present invention is shown. The flashlight 100 is generally comprised of a flashlight head 102, a body 104 and a switch assembly 106. The flashlight body 104 is constructed in part of a battery tube 108 characterized by a barrel section 110 and an integral lamp head section 113 having a flared or bowl shape. The barrel section 110 is provided with external threads at 115 while the lamp head section 113 is provided with external threads at 117. An annular groove 119 is provided adjacent threads 115 for receiving an o-ring 120. A sleeve 122 is disposed over the unthreaded portion of the barrel section 110. The barrel section 110 receives one or more energy cells 124, each energy cell 124 having a positive contact 126 and a negative contact 128. The energy cells 124 are preferably, but not by way of limitation, lithium batteries, although any standard energy cell may be utilized.

The head 102 includes a lens ring 131, lens 133, a reflector 135 and a lamp assembly 200. The ring 131 is provided with internal threads 137 for engagement with the external threads 117 of the lamp head section 113 so that the lens 133, the reflector 135, and the lamp assembly 200 are secured within the bowl of the lamp head section 113.

Figure 1:
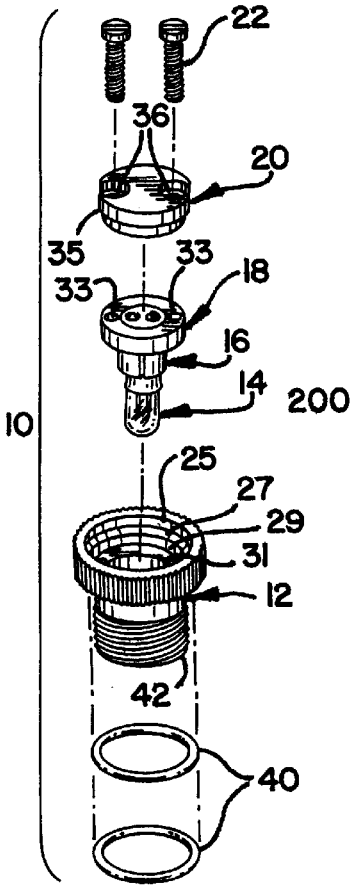
FIG. 1 PRIOR ART
FIG. 1 is an exploded perspective view of a lamp bulb assembly of the prior art.
Figure 2:
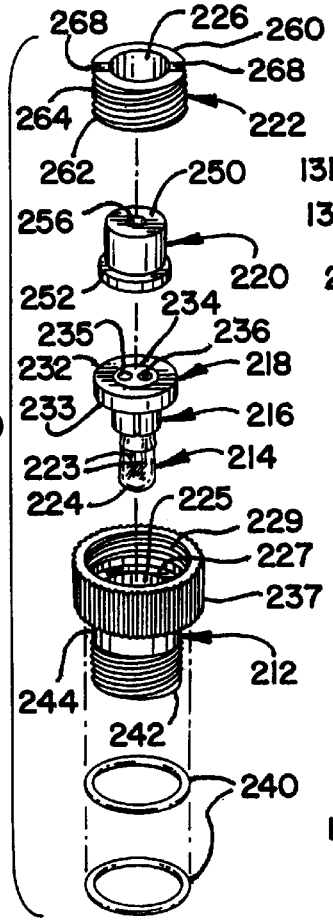
FIG. 2 is an exploded perspective view of the lamp bulb assembly of the present invention.

The lamp assembly 200 is shown in greater detail in FIG. 2. Such a lamp assembly includes an outer adjustment ring 212, a lamp 214, a bulb shock absorber 216, a circuit board 218, a board containment member 220, and a non-conductive fastener 222. The outer adjustment ring 212 and the board containment member 220 are formed of electrically conductive material. The lamp 214, which is commercially available, comprises a filament 223 disposed within a bulb 224 from which extend positive and negative pins (not shown). The lamp 214 is mounted on the circuit board 218 via shock absorber 216. The lamp bulb 224 is preferably, but not by way of limitation, 6-volt halogen pin lamp bulb, although any standard lamp may be utilized.

The circuit board 218 has a positive side 232 and a negative side 233. The positive side 232 is provided with a positive electrode 234 and the negative side 233 is provided with a negative electrode (not shown). A positive pin receptacle 235 and a negative pin receptacle 236 extend between the positive and negative sides of the circuit board 218. The positive pin receptacle 235 is in electrical contact with the positive electrode 234 and the negative receptacle 236 is in electrical contact with the negative electrode (not shown). The positive and negative receptacles 235, 236 are disposed for receiving the positive and negative pins of the lamp (not shown).

The outer adjustment ring 212 has a through bore 225 in which is defined a radial shoulder 227. The circuit board 218 is seated within the through bore 225 such that the negative electrode (not shown) of the board 218 abuts the radial shoulder 227, thereby enabling electrical contact therebetween. The through bore 225 is further provided with a section of internal threads 229. Externally, the adjustment ring 212 is provided with a gripping surface 237 and threads 242. To accommodate o-rings 240, the adjustment ring 212 further includes a groove 244 disposed between the gripping surface 237 and the threads 242.

The board containment member 220 is disposed adjacent the positive side 232 of the board 218 to contain the board 218 within the adjustment ring 212. The containment member 220 has a first closed end 250, a second open end 252, and a bore 254 extending therebetween. The first closed end 250 is provided with an aperture 256 at its center. The second open end 252 is provided with an annular shoulder 258. When disposed to contain the board 218, the annular shoulder 258 abuts the positive electrode 234 of the board 218, thereby enabling electrical contact therebetween. The containment member 220 is provided with the bore 256 to permit the positive and negative pin receptacles 234, 235 to extend through the board 218 without interference by the containment member 220.

Figure 5:
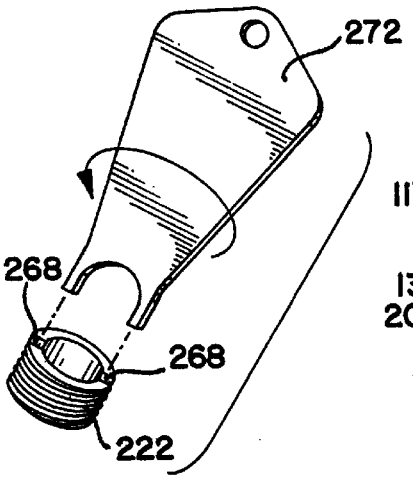
FIG. 5 is a perspective view of a tool being used with the fastener of the present invention.

To retain the containment member 220 against the circuit board 218, the lamp assembly 200 is provided with a non-conductive fastener 222. The fastener 222 includes a first end 260, a second end 262, a threaded outer surface 264, and a bore 266 extending through the fastener 222 from the first end 260 to the second end 262. To assist in threading the fastener 222 into place, the first end 260 of the fastener 222 is provided with two cut-outs 268 to accommodating a tool 272 such as a spanner wrench as shown in FIG. 5 or a scissors found on a Swiss Army knife. In order to retain the containment member 220 against the circuit board 218, the fastener 222 is threaded in place over the containment member 220, the exterior threads 264 of the fastener 222 cooperating with the internal threads 229 of the adjustment ring 212. When the fastener 222 is in place, as shown in FIG. 4, its second end 262 abuts against the annular shoulder 252 of the member 220 and a portion of the member 220 is accommodated within the bore 266 of the fastener 222.

Figure 4:
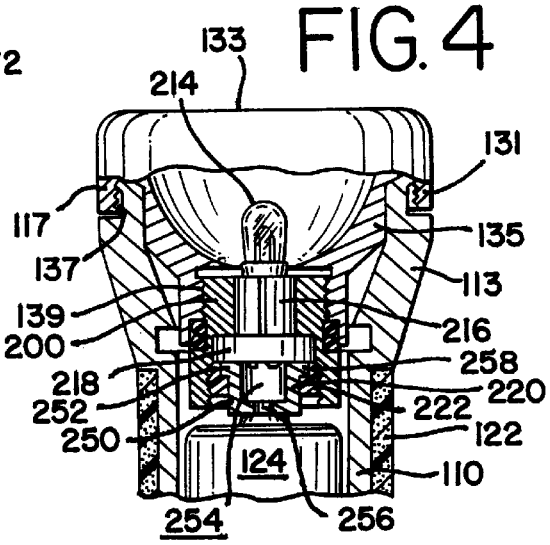
FIG. 4 is an enlarged view of the lamp bulb assembly shown in FIG. 3.

As shown in FIGS. 3 and 4, the lamp assembly 200 is threadingly engaged to the reflector 135. The reflector 135 is provided with internal threads 139 that are disposed for engagement with the external threads 242 of the adjustment ring 212. The o-rings 240 are mounted within the groove 244 to prevent inadvertent movement of the lamp assembly 200 relative to the reflector 135. When the lamp assembly 200 is engaged to the reflector 135, electrical contact is enabled between the adjustment ring 212 and the reflector 135.

Once the lamp assembly 200 is engaged to the reflector 135, the energy cells 124 can be placed in the barrel section 110 of the flashlight 100 and the switch assembly 106 can be threadingly engaged to the barrel section 110. Once the switch assembly is activated, electric current flows from the energy cells 124 through the containment member 220 to the circuit board 218 and ultimately to the bulb 224. To achieve the desired beam of light, the lamp assembly 200 is moved relative to the fixed position of the reflector 135.

While the invention has been described in connection with certain embodiments, it should be understood that it is not intended to limit the invention to these particular embodiments. To the contrary, it is intended to cover all alternatives, modifications and equivalents falling within the spirit and scope of the invention.

I claim:

1. A lamp assembly for a portable light, comprising:

a. an assembly member having a through bore, an internal shoulder, and a section of internal threading;

b. a base for supporting a light bulb;

c. a light bulb adapted to be connected to the base;

d. a board containment member for containing the base within the assembly member; and e. a fastener having external threading for mating with the internal threading of the through bore of the assembly member, and sandwiching a portion of said board containment member between said base and the threads of the fastener.

2. The lamp assembly of claim 1 wherein the base is a circuit board.

3. The lamp assembly of claim 2 wherein the circuit board is sandwiched between the internal shoulder of the assembly member and the board containment member.

4. The lamp assembly of claim 2 wherein the board containment member further includes an annular shoulder at one end, the circuit board being sandwiched between the internal shoulder of the assembly member and the annular shoulder of the board containment member.

5. The lamp assembly of claim 1 wherein the board containment member further includes a passageway extending therethrough.

6. The lamp assembly of claim 1 further comprising a resilient member positioned between the light bulb and the base for securing the light bulb in a substantially fixed position relative to the base.

7. The lamp assembly of claim 1 wherein the fastener is non-conductive.

8. The lamp assembly of claim 1 wherein the fastener is provided at one end with two cut-out portions for accommodating a tool.

9. The lamp assembly of claim 8 wherein the tool is a spanner wrench.

10. The lamp assembly of claim 1 wherein the fastener includes a bore extending therethrough for accommodating the board containment member.

11. The lamp assembly of claim 1 wherein the assembly member is provided with external threading for engaging a reflector.

12. The lamp assembly of claim 10 wherein the assembly member is further provided with a groove for accommodating an o-ring.

13. In a flashlight having a head section, a body section, and a switch assembly, the head section including an assembly member having a through bore, a base for supporting a light bulb, a bulb adapted to be mounted on the base, and a board containment member for containing the base within the assembly member, the improvement comprising:

the assembly member having an internal shoulder and a section of internal threading; and a non-conductive fastener having external threading for mating with the internal threading of the assembly member to retain the board containment member against the base.

14. The improvement of claim 13 wherein the board containment member further includes an annular shoulder, the fastener retaining the annular shoulder of the containment member against the base.

15. The improvement of claim 14 wherein the base is sandwiched between the internal shoulder of the assembly member and the annular shoulder of the board containment member.

16. The improvement of claim 13 wherein the fastener is provided at one end with two cut-out portions for accommodating a tool.

17. The improvement of claim 16 wherein the tool is a spanner wrench.

18. A flashlight comprising:

a. a head section including an assembly member having a through bore, an internal shoulder, and a section of internal threading; a base for supporting a light bulb; a light bulb adapted to be connected to the base; a board containment member for containing the base against the internal shoulder of the assembly member; and a non-conductive fastener for retaining the board containment member against the base, the fastener having external threading for mating with the internal threading of the through bore of the assembly member;

b. a body section engaged to the head section, the body section for receiving one or more energy cells; and c. a switch assembly for controlling the operation of the lamp.

19. The flashlight of claim 18 wherein the board containment member further includes an annular shoulder, the base being sandwiched between the internal shoulder of the assembly member and the annular shoulder of the board containment member.

20. A lamp assembly for a portable light, comprising:

a. an assembly member having a through bore, an internal shoulder, and a section of internal threading;

b. a base for supporting a light bulb;

c. a light bulb adapted to be connected to the base;

d. a board containment member for containing the base within the assembly member; and e. a non-conductive fastener for retaining the board containment member against the base, the fastener having external threading for mating with the internal threading of the through bore of the assembly member.

21. The lamp assembly of claim 20 wherein the base is a circuit board.

22. The lamp assembly of claim 21 wherein the circuit board is sandwiched between the internal shoulder of the assembly member and the board containment member.

23. The lamp assembly of claim 20 wherein the board containment member further includes an annular shoulder at one end, the circuit board being sandwiched between the internal shoulder of the assembly member and the annular shoulder of the board containment member.

24. The lamp assembly of claim 20 wherein the board containment member further includes a passageway extending therethrough.

25. The lamp assembly of claim 20 further comprising a resilient member positioned between the light bulb and the base for securing the light bulb in a substantially fixed position relative to the base.

26. The lamp assembly of claim 20 wherein the fastener is provided at one end with two cut-out portions for accommodating a tool.

27. The lamp assembly of claim 26 wherein the tool is a spanner wrench.

28. The lamp assembly of claim 20 wherein the fastener includes a bore extending therethrough for accommodating the board containment member.

29. The lamp assembly of claim 20 wherein the assembly member is provided with external threading for engaging a reflector.

30. The lamp assembly of claim 29 wherein the assembly member is further provided with a groove for accommodating an o-ring.

31. A lamp assembly for a portable light, comprising:

a. an assembly member having a through bore, an internal shoulder, and a section of internal threading;

b. a base for supporting a light bulb;

c. a light bulb adapted to be connected to the base;

d. a board containment member for containing the base within the assembly member; and e. a fastener for retaining the board containment member against the base, the fastener having external threading for mating with the internal threading of the through bore of the assembly member, wherein the fastener includes a bore extending therethrough for accommodating the board containment member.

32. The lamp assembly of claim 31 wherein the base is a circuit board.

33. The lamp assembly of claim 32 wherein the circuit board is sandwiched between the internal shoulder of the assembly member and the board containment member.

34. The lamp assembly of claim 31 wherein the board containment member further includes an annular shoulder at one end, the circuit board being sandwiched between the internal shoulder of the assembly member and the annular shoulder of the board containment member.

35. The lamp assembly of claim 31 wherein the board containment member further includes a passageway extending therethrough.

36. The lamp assembly of claim 31 further comprising a resilient member positioned between the light bulb and the base for securing the light bulb in a substantially fixed position relative to the base.

37. The lamp assembly of claim 31 wherein the fastener is provided at one end with two cut-out portions for accommodating a tool.

38. The lamp assembly of claim 37 wherein the tool is a spanner wrench.

39. The lamp assembly of claim 31 wherein the fastener is non-conductive.

40. The lamp assembly of claim 31 wherein the assembly member is provided with external threading for engaging a reflector.

41. The lamp assembly of claim 40 wherein the assembly member is further provided with a groove for accommodating an o-ring.

42. A lamp assembly for a portable light, comprising:

a. an assembly member having a through bore, an internal shoulder, and a section of internal threading;

b. a base for supporting a light bulb;

c. a light bulb adapted to be connect to the base;

d. a board containment member for containing the base within the assembly member; and e. a fastener for retaining the board containment member against the base, the fastener having external threading for mating with the internal threading of the through bore of the assembly member, and wherein the fastener is provided at one end with two cut-out portions for accommodating a tool.

43. A lamp assembly for a portable light, comprising:

a. an assembly member having a through bore, an internal shoulder, and a section of internal threading;

b. a base for supporting a light bulb;

c. a light bulb adapted to be removably mounted on the base;

d. a board containment member for containing the base within the assembly member; and e. a fastener for retaining the board containment member against the base, the fastener having external threading for mating with the internal threading of the through bore of the assembly member, and wherein the assembly member is provided with external threading for engaging a reflector.

* * * * *